US006758794B2

(12) United States Patent
Lee

(10) Patent No.: US 6,758,794 B2
(45) Date of Patent: Jul. 6, 2004

(54) PUNCHING BAG SUPPORTING DEVICE

(76) Inventor: Louis William Lee, 4687 Yawger Rd., Battle Creek, MI (US) 49017

( * ) Notice: Subject to any disclaimer, the term of this patent is extended or adjusted under 35 U.S.C. 154(b) by 173 days.

(21) Appl. No.: 10/079,673

(22) Filed: Feb. 20, 2002

(65) Prior Publication Data

US 2003/0158017 A1 Aug. 21, 2003

(51) Int. Cl.[7] ..... A63B 21/00
(52) U.S. Cl. ..... 482/87; 482/90; 482/83
(58) Field of Search ..... 473/442, 441–448; 482/83–90, 121

(56) References Cited

U.S. PATENT DOCUMENTS

| | | | | |
|---|---|---|---|---|
| 805,543 | A | | 11/1905 | Hayes |
| 825,860 | A | | 7/1906 | McKenzie |
| 843,389 | A | | 2/1907 | Brown |
| 2,262,883 | A | | 11/1941 | Carberry |
| 3,424,458 | A | * | 1/1969 | Hopps |
| 3,556,523 | A | * | 1/1971 | Hooker |
| 3,637,210 | A | | 1/1972 | Brantley |
| 4,147,344 | A | | 4/1979 | Lee |
| 4,186,922 | A | | 2/1980 | Ketchum |
| 4,345,755 | A | | 8/1982 | Eidson |
| 4,593,901 | A | | 6/1986 | Moore et al. |
| 4,911,428 | A | | 3/1990 | Wiece |
| 5,048,822 | A | | 9/1991 | Murphy |
| 5,224,912 | A | | 7/1993 | Moody |
| 5,503,606 | A | | 4/1996 | Stephens |
| 5,542,894 | A | | 8/1996 | Jordan |
| 5,611,760 | A | | 3/1997 | Jordan |
| 5,803,877 | A | | 9/1998 | Franey |
| 5,897,466 | A | | 4/1999 | Capach |
| 6,149,554 | A | * | 11/2000 | Ferguson |

FOREIGN PATENT DOCUMENTS

| | | |
|---|---|---|
| GB | 280461 | 11/1927 |
| RU | 1694170 | 11/1991 |
| RU | 1736530 | 5/1992 |

* cited by examiner

*Primary Examiner*—Jerome Donnelly
(74) *Attorney, Agent, or Firm*—Price, Heneveld, Cooper & DeWitt & Litton, LLP

(57) ABSTRACT

An exercising device includes a first frame, a second frame rotatably supported on the first frame, thereby allowing the second frame to rotate relative to the first frame, and a linear track system fixedly attached to the second member such that track system rotates with the second frame relative to the first frame. The exercise device also includes a vehicle adapted to ride along a length of the track system, and at least one arm pivotally attached to the vehicle at a first location along the arm, and adapted to support the first punching bag at a second location along the arm, the first location being spaced apart from the second location.

39 Claims, 7 Drawing Sheets

PUNCHING BAG SUPPORTING DEVICE

BACKGROUND OF THE INVENTION

The present invention relates to a punching bag supporting device, and in particular to a punching bag supporting device that allows the supported bag to move a distance relative to the person striking the bag when the bag is struck.

Devices for supporting punching bags are used in a wide variety of applications. The devices typically support the bag or bags from the floor or a ceiling and hold the bag in a stationary position and allow the bag to move once struck.

Heretofore, supporting devices for punching bags have allowed for movement of the bag in a linear or circular motion. However, these devices significantly restrict the movement of the bag, make the motions predictable, and the bag easy to make contact with. In addition, these devices do not provide for a "real combat" experience, wherein the movements of the other fighter are difficult to predict and counter. Further, the predictability of these devices lessens the workout provided.

SUMMARY OF THE INVENTION

One aspect of the present invention is to provide an exercising device that includes a first frame, a second frame rotatably supported on the first frame, thereby allowing the second frame to rotate relative to the first frame, and a linear track system fixedly attached to the second member such that the track system rotates with the second frame relative to the first frame. The exercise device also includes a vehicle adapted to ride along a length of the track system, and at least one arm pivotally attached to the vehicle in a first location along the arm and adapted to support a first punching bag in a second location along the arm, wherein the first location is spaced apart from the second location.

Another aspect of the present invention is to provide an exercising device that includes a first frame, a second frame rotatably supported on the first frame, thereby allowing the second frame to rotate relative to the first frame, and a first powered actuator operably connected with the second frame to rotate the second frame relative to the first frame. The exercising device also includes a linear track system fixedly attached to the second member such that the track system rotates with the second frame relative to the first frame, a vehicle adapted to ride along a length of the track system, and a second powered actuator operably connected to the vehicle to move the vehicle along the length of the track system. The exercising device further includes at least one arm pivotally attached to the vehicle and adapted to support a device for striking.

DETAILED DESCRIPTION OF THE PREFERRED EMBODIMENTS

Figure 1:
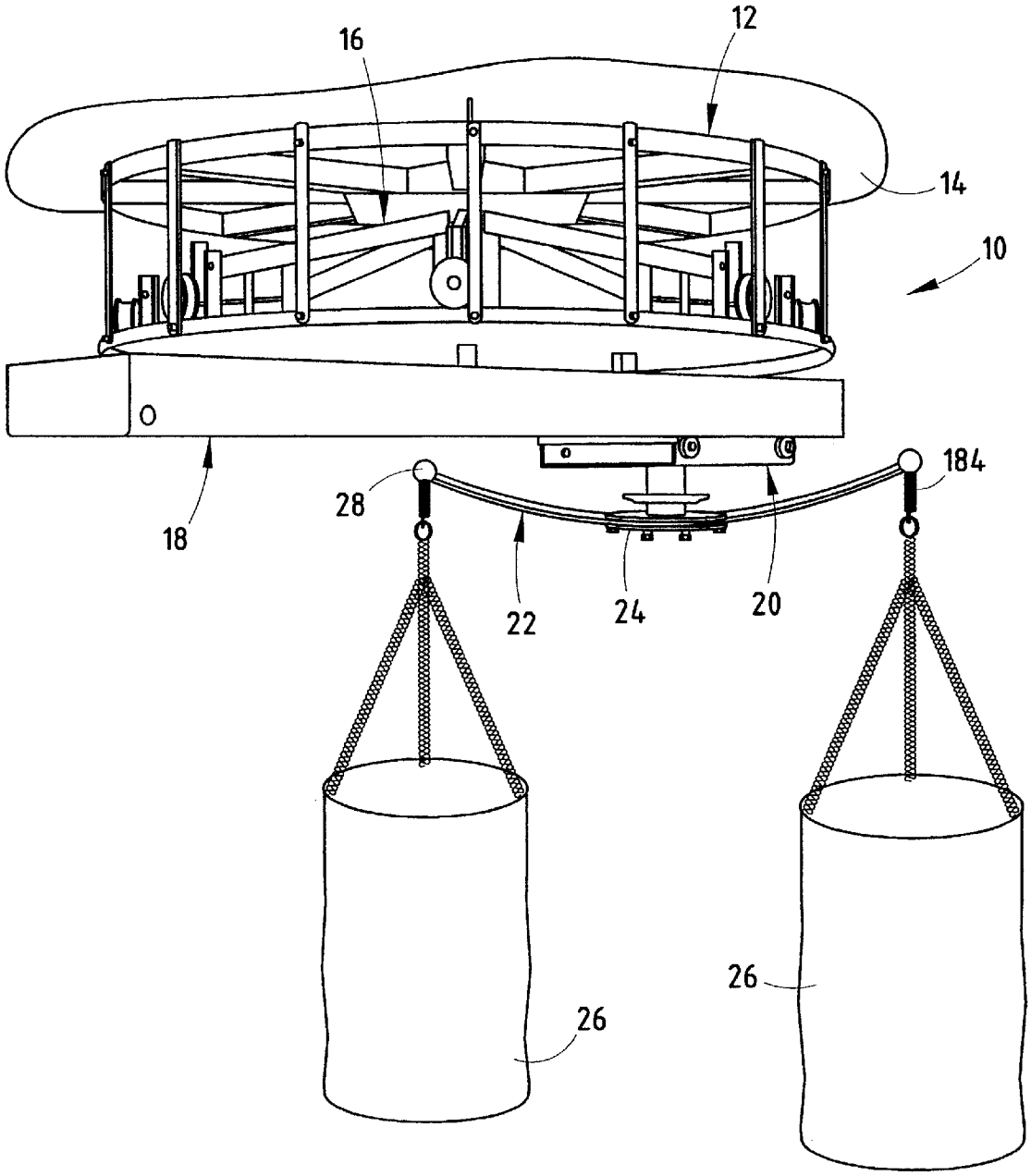
FIG. 1 is a perspective view of a punching bag supporting device embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are exemplary embodiments of the inventive concepts defined in the appended claims. Hence, specific dimensions and other physical characteristics relating to the embodiments disclosed herein are not to be considered as limiting, unless the claims expressly state otherwise.

Figure 2:
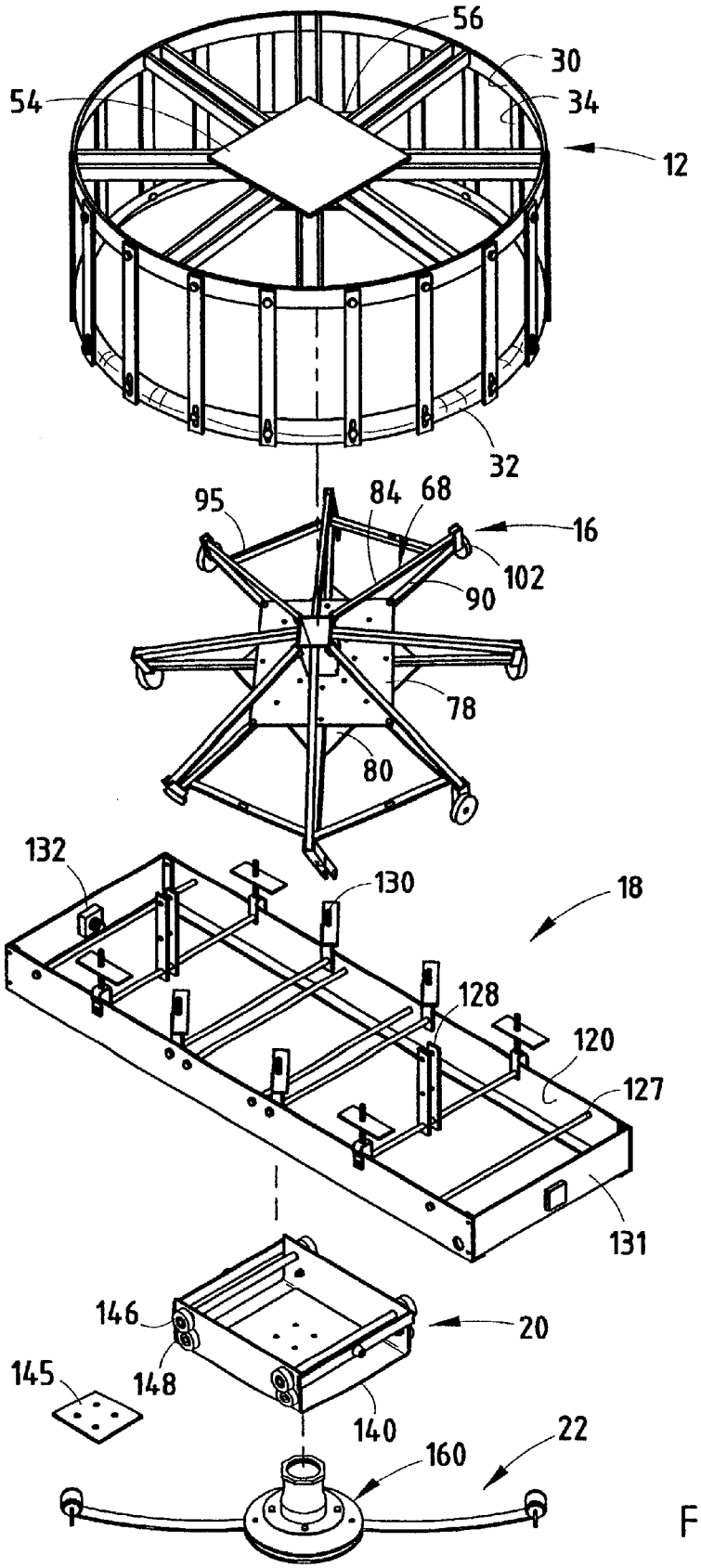
FIG. 2 is an exploded perspective view of the punching bag supporting device.

The reference numeral 10 (FIGS. 1 and 2) generally designates a punching bag supporting device or exercising device embodying the present invention. In the illustrated example, exercising device 10 includes a first frame or housing 12 fixedly attached to a ceiling 14, and a second frame or carousal 16 rotatably supported within housing 12, thereby allowing carousal 16 to rotate relative to housing 12. Exercising device 10 also includes a linear track system 18 fixedly attached to carousal 16 such that track system 18 rotates with carousal 16 relative to housing 12, and a vehicle 20 that translates along a length of track system 18. Exercise device 10 further includes at least one arm 22 pivotally attached to vehicle 20 at a first location 24 along arm 22, and adapted to support a punching bag 26 at a second location 28 along arm 22, wherein first location 24 is spaced apart from second location 28.

Figure 3:
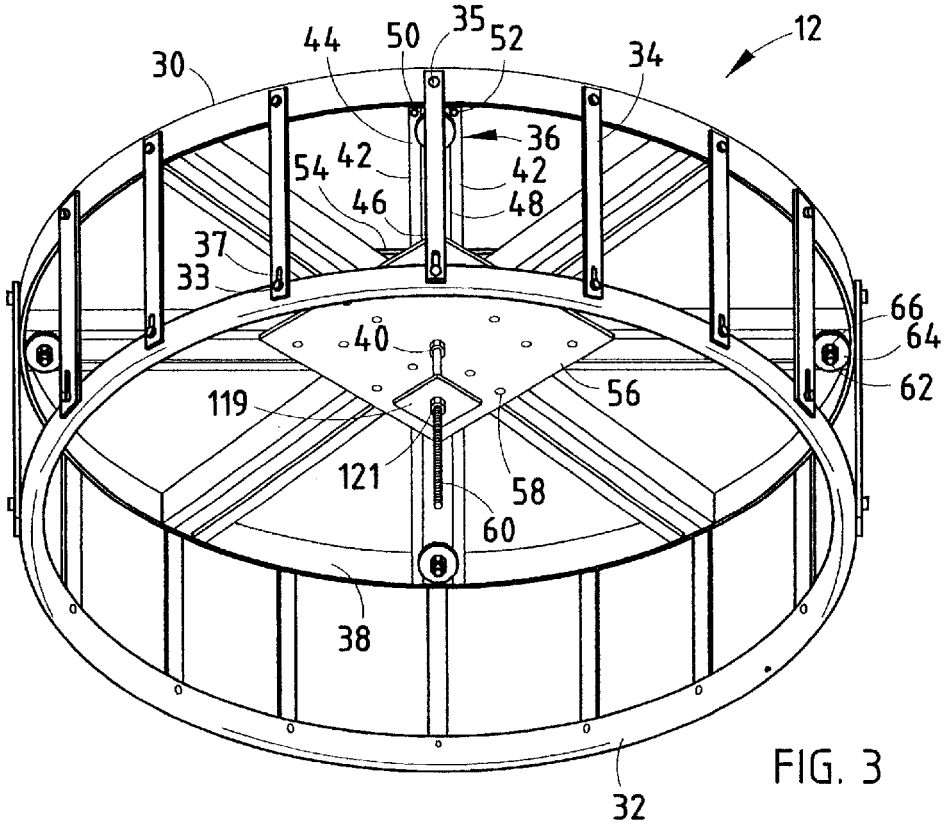
FIG. 3 is a perspective view of a supporting frame.

The first frame or housing 12 (FIG. 3) includes a circularly-shaped upper support member 30 and a circularly-shaped lower support member or rail 32 having a circular cross sectional geometrical shape. A plurality of downwardly extending supports 34 are fixedly attached to upper support member 30 and rail 32, via a plurality of bolts and nuts 33, thereby supporting rail 32 from upper support member 30. Each support 34 is provided with a slot 37 at a lower end thereof for receiving an associated bolt 33 therein. Slots 37 allow the height of rail 32 to be adjusted, thereby assuring that rail 32 is completely horizontal allowing for proper operation of device 10. Housing 12 further includes a plurality of structural supporting arms 36 that are fixedly attached to upper support member 30 and extend radially inward from an inner surface 38 of upper support member 30 towards a central point 40. Each structural supporting arm 36 includes a pair of spaced apart arms 42 having a distal end 44 and a proximal end 46, and that define a channel 48 therebetween. An L-shaped end plate 50 extends between distal end 44 of each arm 42 and is connected thereto via a pair of bolts 52. Proximal end 46 of each arm 42 is fixedly held between an upper retainer plate 54 and a lower retainer plate 56 via a plurality of bolts 58. A central axle 60 extends downwardly from lower retainer plate 56 through central point 40 and is threaded for a portion of the overall length thereof. Housing 12 is fixedly attached to ceiling 14 via a plurality of bolts 62 that extend through the channels 48 between arms 42 near distal ends 44. Flat washer 64 are located over each bolt 62, abut arms 42 and are held in place by nuts 66.

Figure 4:
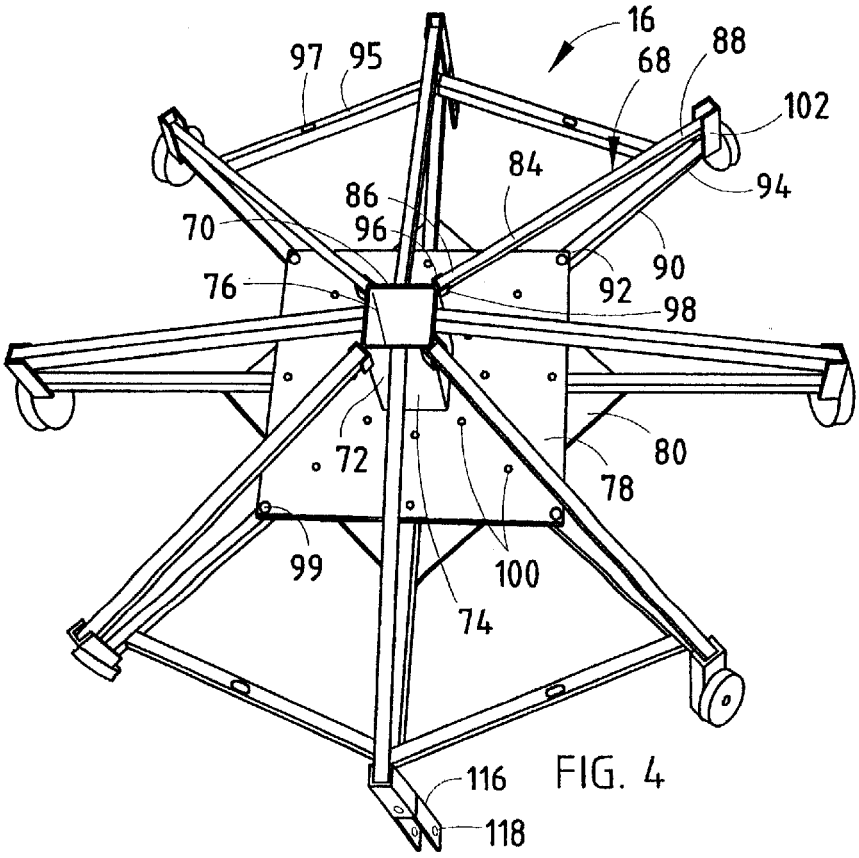
FIG. 4 is a perspective view of a carousal frame.
Figure 5:
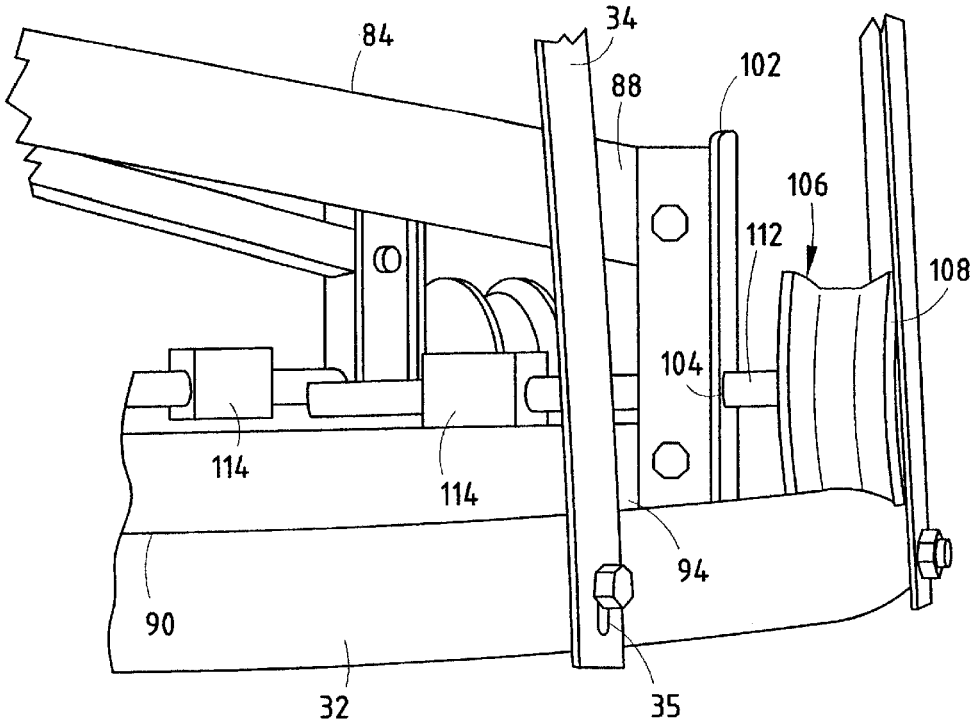
FIG. 5 is an enlarged, fragmentary front view of the carousal supported on the supporting frame.

The second frame or carousal 16 (FIG. 4) has an overall octagon shape and includes a plurality of arm assemblies 68 extending radially outward from a square-shape central hub 70 having an upper end 72 and a lower end 74, and defines an interior 76 therein. Carousal 16 also includes an upper retainer plate 78 fixed to lower end 74 of hub 70 and extending radially outward therefrom, and a lower retainer plate 80 extending radially outward from hub 70. Each arm assembly 68 includes an upper arm 84 having a proximal end 86 and a distal end 88, and a lower arm 90 having a proximal end 92 and distal end 94. Upper arm 84 and lower arm 90 each have a square-shaped cross sectional geometry. Proximal end 86 of each upper arm 84 is attached to upper end 72 of hub 70 via a pair of flanges 96 that are fixedly attached to and extend radially outward from hub 70. Proximal end 86 of each upper arm 84 is held between the associated flanges 96 via hardware such as a bolt and nut (not shown). Proximal end 92 of lower arm 90 is fixedly held between upper retainer plate 78 and lower retainer plate 80 via a plurality of bolts 100. A plurality of track support arms 95 are fixedly attached to and extend between distal ends 94 of lower arms 90. Each arm 95 has an aperture 97 extending vertically therethrough. A C-shaped, inwardly facing bearing plate 102 (FIG. 5) extends between and is fixedly attached to distal end 88 of upper arm 84 and distal end 94 of lower arm 90. Each bearing plate 102 includes a bearing aperture 104 extending therethrough. Carousal 16 further includes a plurality of caster assemblies 106 that each include a caster 108 that rides along rail 32, an axle 112 fixedly attached to caster 108 and extending through an aperture 104 of an associated bearing plate 102, and an inner bearing surface 114 that rotatably receives and guides a portion of axle 112. Carousal 16 still further includes two pairs of track system supporting flanges 116 extending downwardly from a pair of bearing plates 102 juxtaposed across carousal 16. Each flange 116 has an aperture 118 extending laterally therethrough. In assembly, a spacer 119 (FIG. 3) is located along axle 60 and held in place via a nut 121. Spacer 119 is located within interior 76 of central hub 70 and is allowed to freely rotate about axle 60.

Figure 6:
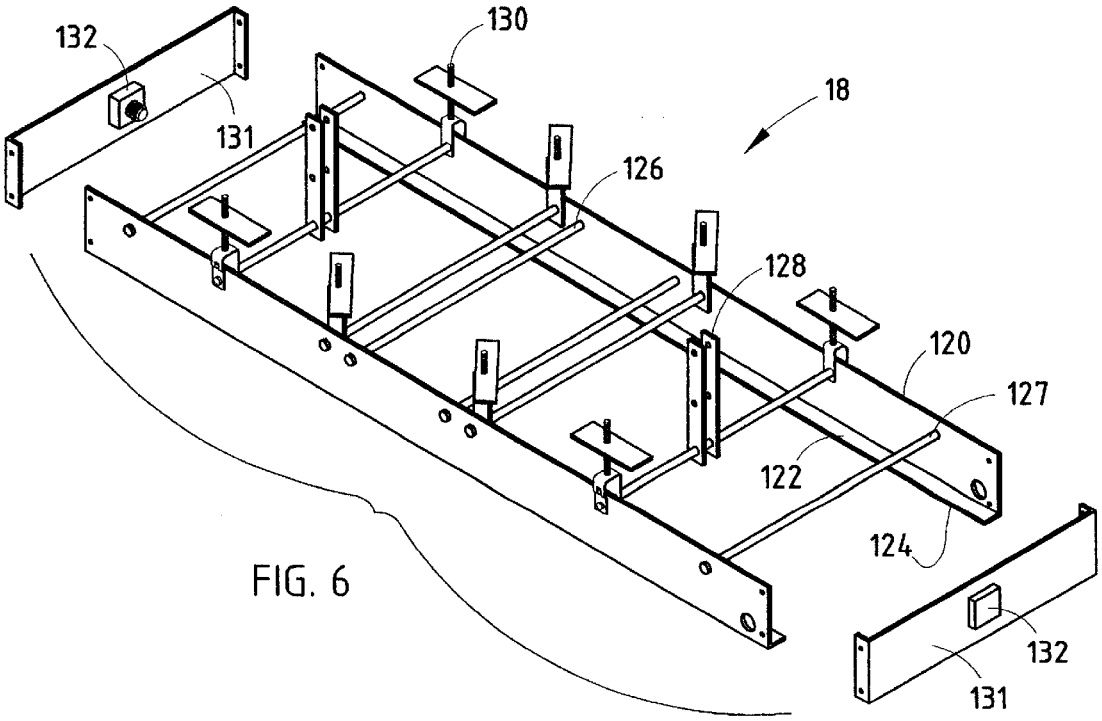
FIG. 6 is an exploded perspective view of a track assembly.
Figure 7:
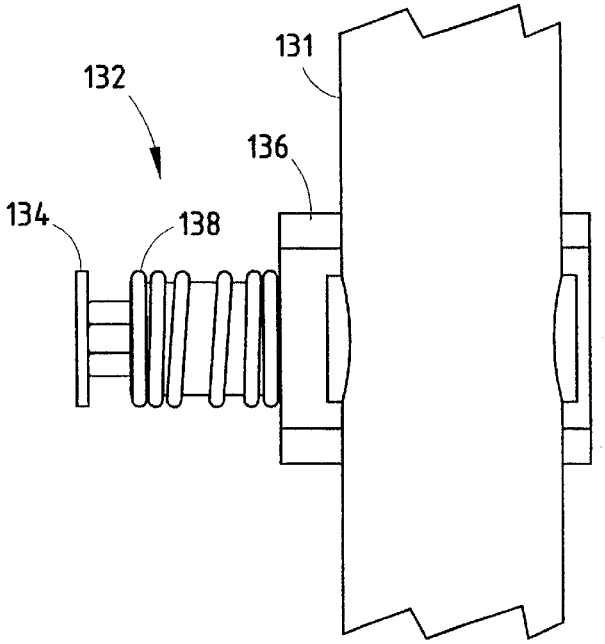
FIG. 7 is an enlarged, fragmentary view of a bumper.

The track system 18 (FIG. 6) includes a pair of L-shaped longitudinally extending rails or track members 120. Each track member 120 includes an upper supporting surface 122 and a bottom surface 124. A plurality of tie bars 126 extend laterally between track members 120 and are fixedly attached thereto. A pair of track supports 128 extend upwardly from a center portion of a pair of the tie bars 126 and are adapted to extend through and be attached to upper arms 84 and lower arms 90 of carousal 16 via hardware such as nuts and bolts. The outermost tie bars 127 are adapted to extend through apertures 118 of flanges 116. Track system 18 further includes a plurality of upwardly extending support rods 130 that extend through apertures 97 of arms 95 of carousal 16, thereby assisting in supporting track system 18 therefrom. Track system 18 further includes end walls 131 extending between and attached to the ends of each track member 120. A spring assembly 132 (FIG. 7) is fixedly attached and extends inwardly from each end wall 131. In the illustrated example, spring assembly 132 includes a bumper stop 134 that is biased away from a stop block 136 via a coil spring 138 positioned therebetween. Bumper stop 134 is slidably received by stop block 136, however, is affixed thereto such that bumper stop 134 cannot be completely removed from stop block 136. The spring assemblies 132 are adapted to force vehicle 20 away from end walls 131 when abutted by vehicle 20 as described below.

Figure 8:
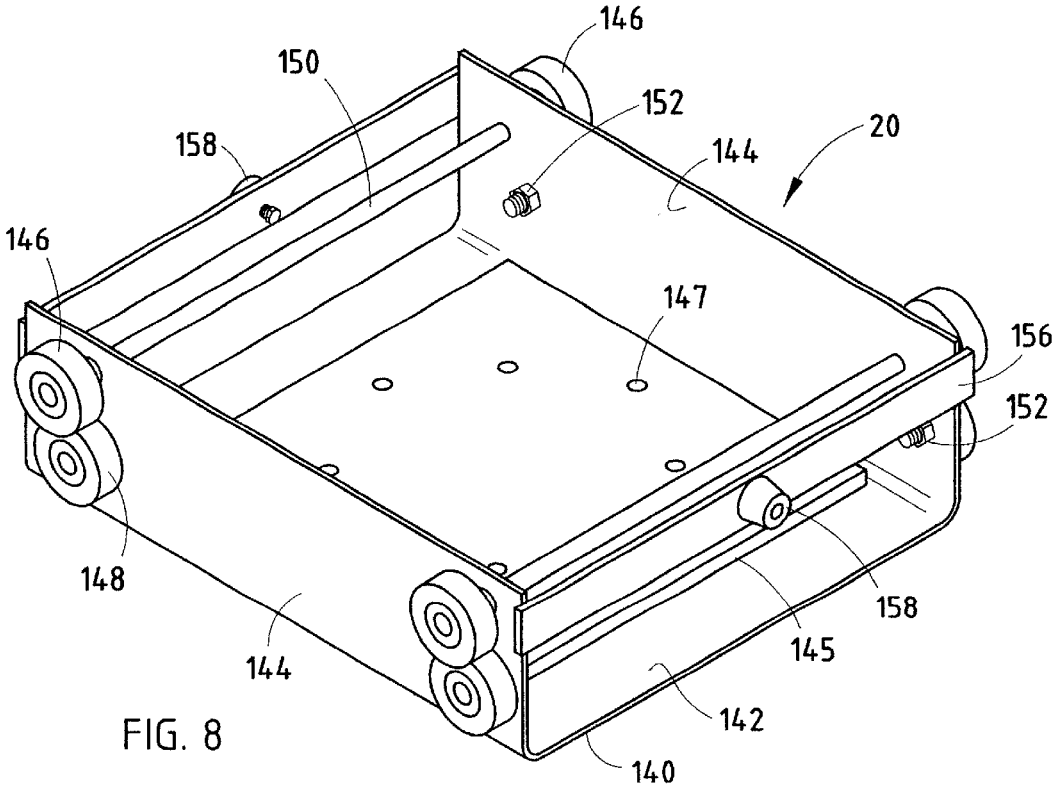
FIG. 8 is a perspective view of a vehicle.
Figure 9:
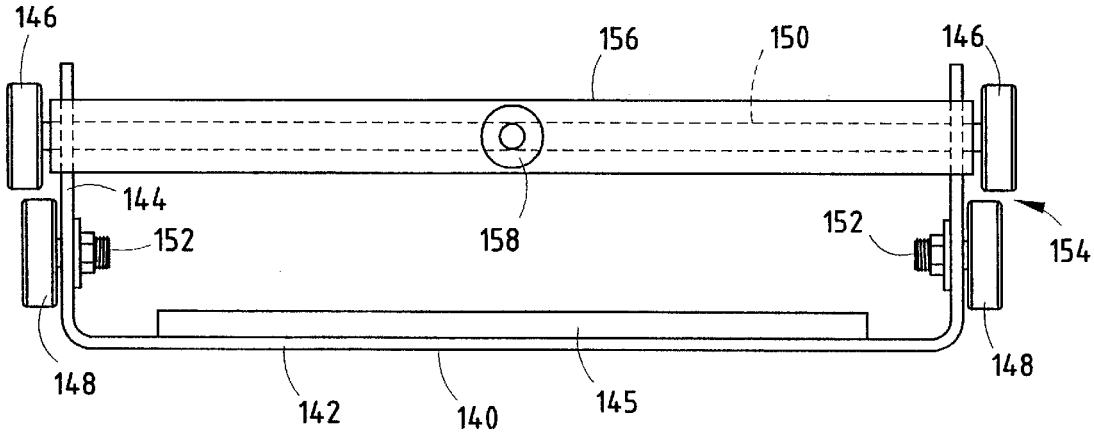
FIG. 9 is a side elevational view of the vehicle.

The vehicle 20 (FIGS. 8 and 9) includes an upwardly opening, C-shaped housing 140 defined by a bottom wall 142 and a pair of longitudinally extending side walls 144. A reinforcement plate 145 is affixed to an upper side of bottom wall 142. Both bottom wall 142 of housing 140 and plate 145 include a plurality of apertures 147 for receiving hardware therein to support arms 22 as discussed below. Vehicle 20 also includes a plurality of supporting wheels 146 and a plurality of guide wheels 148. Specifically, two pairs of supports wheels 146 are mounted outside side walls 144 of housing 140 and are connected via axles 150 extending therebetween. Guide wheels 148 include two pairs of guide wheels rotatably supported from side walls 144 of housing 140 via axle bolts 152, and are vertically aligned with an associated supporting wheel 146, thereby defining a gap 154 therebetween. Supporting wheels 146 are adapted to track along top surface 122 of each track member 120, while guide wheels 148 are adapted to guide along bottom surface 124 of each track member 120 as vehicle 20 travels along track system 18 as described below. Vehicle 20 also includes an end plate 156 located at and fixedly attached to each end of housing 140. A bumper 158 is fixedly attached to a central portion of each end plate 156. In the illustrated example, each bumper 158 is constructed of a rubber or a polymeric material and is adapted to cushiongly abut bumper stop 134 of spring assembly 132 as described below.

Figure 10:
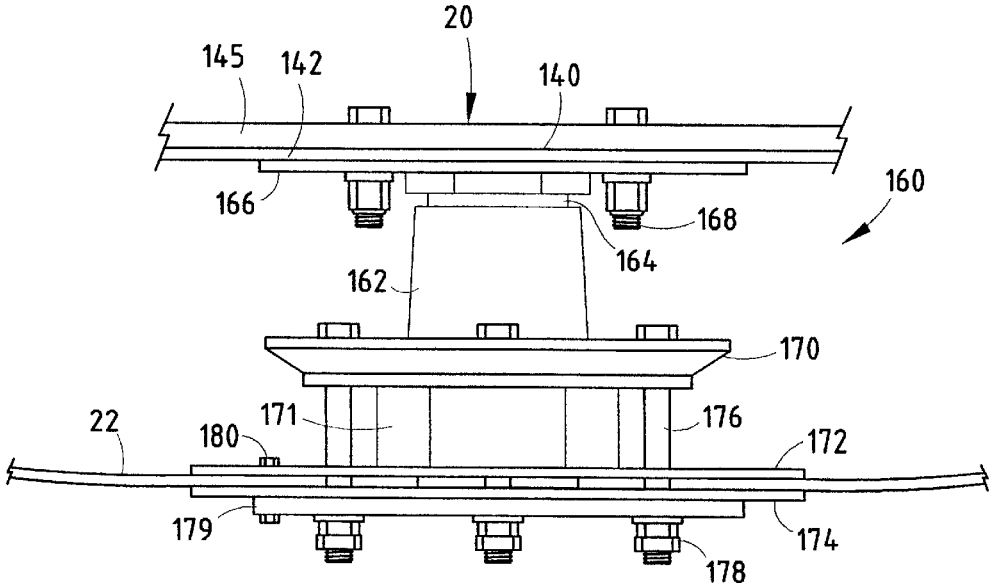
FIG. 10 is a fragmentary front view of a support assembly and support arms.
Figure 11:
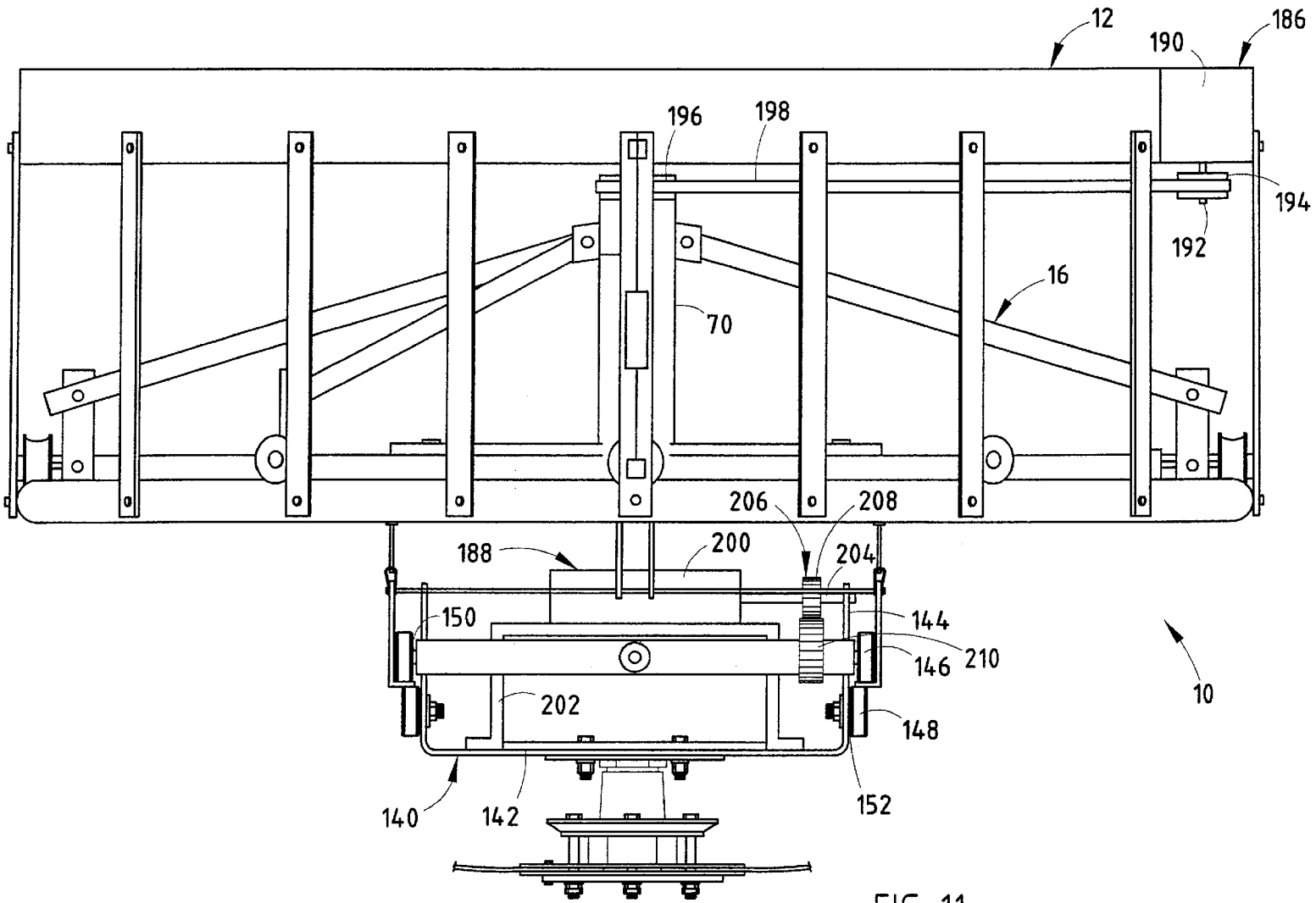
FIG. 11 is a front elevational view of an alternative embodiment of the punching bag supporting device including two drive motors.

A support assembly 160 (FIG. 10) extends downwardly from and is fixedly attached to bottom wall 142 of housing 140. Support assembly 160 includes a housing 162 that pivotally houses a shaft 164 therein. Shaft 164 is fixedly attached to a support plate 166 that is in turn fixedly attached to bottom wall 142 of housing 140 via a plurality of bolts and nuts 168 extending through apertures 147. A support flange 170 is fixedly attached and extends radially outward from housing 162. Support assembly 160 further includes a first retainer plate 172 and second retainer plate 174. In the illustrated example, a plurality of bolts 176 extend through support flange 170, first retainer plate 172 and second retainer plate 174, and are held in place by a plurality of nuts 178, thereby supporting first and second retainer plates 172 and 174 from support flange 170 and holding arms 22 therebetween.

In the illustrated example, a pair of curved arms 22 extend radially outward from support assembly 160 and are fixedly attached thereto. Specifically, first location 24 of each arm 22 is fixedly held between first retainer plate 172 and second retainer plate 174 via bolts 180 and nuts 182 as well as by bolts 176 and nuts 178. Second location 28 is located near an end of each arm 22 and is adapted to support a striking device such as a punching bag 26 therebelow. In the illustrated example, second location 28 of each arm 22 includes a hook 184 from which to support punching bag 26, however, other means of support and attachment may be used to support a variety of striking devices such as heavy bags, speed bags, striking dummies, and the like. As illustrated, each arm 22 is constructed of an upwardly bent spring steel, however, other geometrical configurations and materials suitable for such use may be utilized.

In operation, the mobility of device 10 about multiple points of rotation coupled with the linear movement of vehicle 20 along track system 18, allows for significant and less predictable movement of the associated bag 26. In the illustrated example, device 10 allows for simultaneous rotation of carousal 16 and track system 18 with respect to frame 12, linear movement of vehicle 20 along track system 18, and the rotation of arms 22 with respect to vehicle 20, thereby allowing for simultaneous movement of bags 26 within two rotational planes and linear movement along track system 18.

In an alternative embodiment, exercising device 10 includes a first motor 186 and a second motor 188. In the illustrated example, first motor 186 includes a variable speed electric motor having a housing 190 fixedly attached to housing 12 of exercise device 10. First motor 186 further includes a power shaft 192 and a pulley 194 fixedly attached power shaft 192. Motor 186 is operably connected with hub 70 via a pulley 196 and a drive belt 198 extending between pulley 194 and pulley 196. In operation, motor 186 rotates carousal 16 within frame 12 in both directions of rotation, thereby making bags 26 increasingly difficult to contact.

In the illustrated example, second motor 188 includes a variable speed electric motor having an outer housing 200 fixedly attached to a motor mounting bracket 202 located above and fixedly attached to bottom wall 142 of housing 140. Second motor 188 further includes a power shaft 204 operably connected to at least one axle 150 of vehicle 20 via a gear frame. Gear frame 206 includes a first gear 208 fixedly attached to power shaft 204 of second motor 188, and a second gear 210 fixedly attached to axle 150 of vehicle 20. In operation, motor 188 motivates vehicle 20 along track system 18 in both directions of travel, again making bags 26 increasingly difficult to contact.

The present inventive exercising device 10 provides an increased and less predictable movement pattern for the bags 26 (or other striking devices) supported therefrom. The increased movement both increases the intensity of the workout, but also more accurately duplicates a "real combat" situation, wherein an opponent's movement may be sporadic and unpredictable.

In the foregoing description, it will be readily appreciated by those skilled in the art that modifications made be made to the invention without departing from the concepts disclosed herein. Such modifications are to be considered as included in the following claims, unless these claims by their language expressly state otherwise.

The invention claimed is:

1. An exercising device, comprising:

a first frame including a circular support ring adapted to mount to a ceiling;

a second frame rotatably supported on the first frame, thereby allowing the second frame to rotate relative to the first frame, and wherein the second frame includes a plurality of wheels that rotatably support the second frame by the support ring of the first frame;

a linear track system fixedly attached to the second frame such that the track system rotates with the second frame relative to the first frame;

a vehicle that translates along a length of the track system; and at least one arm pivotably attached to the vehicle at a first location along the arm, and adapted to support a first punching bag at a second location along the arm, and wherein the first location is spaced apart from the second location.

2. The exercising device of claim 1, wherein the track system includes a pair of linear track members.

3. The exercising device of claim 2, wherein the vehicle includes a plurality of first wheels supporting the vehicle from the track system.

4. The exercising device of claim 3, wherein the vehicle includes a plurality of second wheels contacting the track members, thereby causing the first wheels to remain in contact with the track members.

5. The exercising device of claim 4, wherein the track system includes at least one elastically deformable return member located at an end of the track members, and wherein the return member forces the vehicle away from the end of the track members when compressed by the vehicle.

6. The exercising device of claim 5, wherein the at least one returning member includes a first return member and a second return member located at the end of the track members.

7. The exercising device of claim 4, wherein the arm is pivotably supported by the vehicle via a plate member.

8. The exercising device of claim 7, wherein the plate member includes a first portion and a second portion, the arm being secured between the first portion and the second portion, and wherein the first portion and the second portion are fixedly attached to a shaft pivotably attached to the vehicle.

9. The exercising device of claim 8, wherein first location of the arm is located near a center of the arm, the second location of the arm is located near a first end of the arm, and wherein the arm is adapted to support a second punching bag at a second end of the arm.

10. An exercising device, comprising:

a first frame including a circular support ring;

a second frame rotatably supported on the first frame, thereby allowing the second frame to rotate relative to the first frame, and wherein the second frame includes a plurality of wheels that rotatably support the second frame by the support ring of the first frames;

a linear track system fixedly attached to the second frame such that the track system rotates with the second frame relative to the first frame;

a vehicle that translates along a length of the track system; and at least one arm pivotably attached to the vehicle at a first location along the arm, and adapted to support a first punching bag at a second location along the arm, and wherein the first location is spaced apart from the second location.

11. The exercising device of claim 10, wherein the track system includes a pair of linear track members.

12. The exercising device of claim 11, wherein the track system includes at least one spring mounted near ends of the track members and adapted to bias the vehicle away from the ends of the track members when engaged by the vehicle.

13. The exercising device of claim 12, wherein the track system includes at least one elastically deformable return member located at an end of the track members, and wherein the return member forces the vehicle away from the end of the track members when compressed by the vehicle.

14. The exercising device of claim 13, wherein the at least one returning member includes a first return member and a second return member located at the ends of the track members.

15. The exercising device of claim 12, wherein the vehicle includes a plurality of first wheels contacting the track members and supporting the vehicle from the track system.

16. The exercising device of claim 15, wherein the vehicle includes a plurality of second wheels contacting the track members, thereby causing the first wheels to remain in contact with the track members.

17. An exercising device, comprising:

a first frame;

a second frame rotatably supported on the first frame, thereby allowing the second frame to rotate relative to the first frame;

a linear track system fixedly attached to the second frame such that the track system rotates with the second frame relative to the first frame;

a vehicle that translates along a length of the track system; and at least one arm pivotably attached to the vehicle at a first location alone the arm, and adapted to support a first punching bag at a second location along the arm, and wherein the first location is spaced apart from the second location, and wherein the arm is pivotably supported by the vehicle via a plate member, the plate member includes a first portion and a second portion, the arm being secured between the first portion and the second portion, and wherein the first portion is fixedly attached to a shaft pivotably attached to the vehicle.

18. The exercising device of claim 17, wherein first location of the arm is located near a center of the arm, the seconds location of the arm is located near a first end of the arm, and wherein the arm is adapted to support a second punching bag at a second end of the arm.

19. An exercising device, comprising:

a first frame;

a second frame rotatably supported on the first frame, thereby allowing the second frame to rotate relative to the first frame;

a first powered actuator operably connected with the second frame to rotate the second frame relative to the first frame;

a linear track system fixedly attached to the second frame such that the track system rotates with the second frame relative to the first frame;

a vehicle that translates along a length of the track system;

a second powered actuator operably connected with the vehicle to move the vehicle along the length of the track system; and at least one arm pivotably attached to the vehicle and adapted to support a device for striking.

20. The exercising device of claim 19, wherein the first frame is adapted to mount to a ceiling.

21. The exercising device of claim 1, wherein first frame includes a circular support ring, and wherein the second frame includes a plurality of wheels that rotatably support the second frame by the support ring of the first frame.

22. The exercising device of claim 21, wherein the second frame is rotatably supported on the first frame via a first shaft fixedly attached to the first frame and rotatably attached to the second frame.

23. The exercising device of claim 22, wherein the second frame includes a pulley fixedly attached to the first shaft, and wherein the first powered actuator is operably connected with the pulley via a drive belt.

24. The exercising device of claim 23, wherein the first powered actuator includes a variable speed, electric motor.

25. The exercising device of claim 22, wherein the track system includes a pair of linear track members.

26. The exercising device of claim 25, wherein the vehicle includes a plurality of first wheels supporting the vehicle from the track system.

27. The exercising device of claim 26, wherein the vehicle includes a plurality of second wheels contacting the track members, thereby causing the first wheels to remain in contact with the track members.

28. The exercising device of claim 27, wherein the track system includes at least one elastically deformable return member located at an end of the track members, and wherein the return member forces the vehicle away from the end of the track members when compressed by the vehicle.

29. The exercising device of claim 28, wherein the at least one returning member includes a first return member and a second return member located at the ends of the track members.

30. The exercising device of claim 27, wherein the vehicle includes an axle extending between two or the first wheel juxtaposed across the vehicle, and wherein the second powered actuator is operably connected with the axle via a gear system.

31. The exercising device of claim 30, wherein the second powered actuator includes a variable speed, electric motor.

32. The exercising device of claim 19, wherein first frame includes a circular support ring, and wherein the second frame includes a plurality of wheels that rotatably support the second frame by the support ring of the first frame.

33. The exercising device of claim 19, wherein the track system includes a pair of linear track members.

34. The exercising device of claim 33, wherein the track system includes at least one elastically deformable return member located at an end of the track members, and wherein the return member forces the vehicle away from the end of the track members when compressed by the vehicle.

35. The exercising device of claim 34, wherein the at least one returning member includes a first return member and a second return member located at the ends of the track members.

36. The exercising device of claim 33, wherein the vehicle includes a plurality of first wheels supporting the vehicle from the track system.

37. The exercising device of claim 34, wherein the vehicle includes a plurality of second wheels contacting the track members, thereby causing the first wheels to remain in contact with the track members.

38. The exercising device of claim 36, wherein the vehicle includes an axle extending between two of the first wheels juxtaposed across the vehicle, and wherein the second powered actuator is operably connected with the axle via a gear system.

39. The exercising device of claim 38, wherein the second powered actuator includes a variable speed, electric motor.

* * * * *